US010196799B2

(12) United States Patent
Bjerke et al.

(10) Patent No.: US 10,196,799 B2
(45) Date of Patent: Feb. 5, 2019

(54) GROUND ENGAGING TOOL

(71) Applicant: CATERPILLAR INC., Peoria, IL (US)

(72) Inventors: Nathan Richard Bjerke, Peoria, IL (US); Thomas M. Congdon, Dunlap, IL (US); Edward Harry Betts, Jr., Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 348 days.

(21) Appl. No.: 14/959,788

(22) Filed: Dec. 4, 2015

(65) Prior Publication Data

US 2016/0177543 A1 Jun. 23, 2016

Related U.S. Application Data

(60) Provisional application No. 62/094,713, filed on Dec. 19, 2014.

(51) Int. Cl.
*E02F 9/28* (2006.01)

(52) U.S. Cl.
CPC ..... *E02F 9/2841* (2013.01)

(58) Field of Classification Search
CPC ..... E02F 9/28–9/2883; B25B 27/143; F16B 37/041; F16B 37/044
USPC ..... D15/29
See application file for complete search history.

(56) References Cited

U.S. PATENT DOCUMENTS

| | | | | |
|---|---|---|---|---|
| 2,427,651 | A * | 9/1947 | Baer | E02F 9/2841 37/457 |
| 5,144,762 | A * | 9/1992 | Robinson | E02F 9/2816 37/453 |
| 5,713,145 | A * | 2/1998 | Ruvang | E02F 9/2833 37/455 |
| 5,913,605 | A * | 6/1999 | Jusselin | E02F 9/28 172/772 |
| 5,983,534 | A * | 11/1999 | Robinson | E02F 9/2841 37/452 |
| 6,301,810 | B1 | 10/2001 | Fidler | |
| 6,393,738 | B1 * | 5/2002 | Bierwith | E02F 9/2825 37/455 |
| 6,668,472 | B2 * | 12/2003 | Bierwith | E02F 9/2825 37/455 |
| 6,675,509 | B2 * | 1/2004 | Bierwith | E02F 9/2825 37/452 |
| 8,561,326 | B2 | 10/2013 | Ruvang | |
| 8,776,408 | B2 | 7/2014 | Stewart | |
| 9,315,972 | B2 * | 4/2016 | Anisy | E02F 9/2825 |
| 9,518,379 | B2 * | 12/2016 | Kunz | E02F 9/2891 |
| 2005/0229441 | A1 * | 10/2005 | Maher | E02F 9/2841 37/446 |
| 2005/0229442 | A1 * | 10/2005 | Jones | E02F 9/2825 37/452 |

(Continued)

*Primary Examiner* — Jessica H Lutz
(74) *Attorney, Agent, or Firm* — Finnegan, Henderson, Farabow, Garrett & Dunner, LLP

(57) ABSTRACT

Disclosed are various exemplary embodiments of a ground engaging tool. The tool may have an engagement end. The tool may also have a mounting end opposite the engagement end along a longitudinal axis of the tool. The mounting end may have a first mounting leg. The mounting end may also have a second mounting leg, which may have a mounting surface facing the first mounting leg. The second mounting leg may define a cavity in the tool accessible only through an opening in the mounting surface.

9 Claims, 13 Drawing Sheets

(56) References Cited

U.S. PATENT DOCUMENTS

| | | | | |
|---|---|---|---|---|
| 2007/0044349 | A1* | 3/2007 | McClanahan | E02F 9/2883 37/452 |
| 2008/0005940 | A1* | 1/2008 | Ollinger | E02F 9/2825 37/452 |
| 2008/0023225 | A1* | 1/2008 | Lynde | B24B 49/08 175/39 |
| 2008/0148608 | A1* | 6/2008 | Harder | E02F 9/2825 37/455 |
| 2009/0282711 | A1* | 11/2009 | Naher | E02F 9/2841 37/455 |
| 2013/0145659 | A1* | 6/2013 | LaHood | E02F 3/8152 37/453 |
| 2013/0180137 | A1* | 7/2013 | Hurley | E02F 9/2825 37/455 |
| 2014/0173948 | A1* | 6/2014 | Ok | B23P 6/00 37/452 |
| 2014/0186105 | A1* | 7/2014 | Martinelli | E02F 3/58 403/320 |
| 2014/0202049 | A1* | 7/2014 | Ruvang | E02F 9/2841 37/453 |
| 2014/0215868 | A1 | 8/2014 | Johnston et al. | |
| 2014/0360061 | A1* | 12/2014 | Kunz | E02F 9/2833 37/455 |
| 2016/0369481 | A1* | 12/2016 | Hooijmans | E02F 3/60 |
| 2017/0073938 | A1* | 3/2017 | Bjerke | E02F 3/40 |
| 2017/0138019 | A1* | 5/2017 | Nicoson | E02F 9/2808 |

* cited by examiner

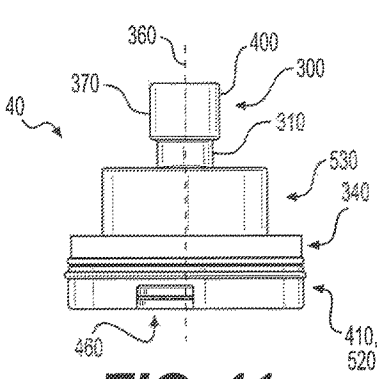
FIG. 11
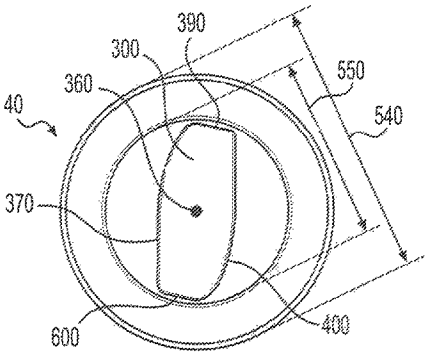
FIG. 10
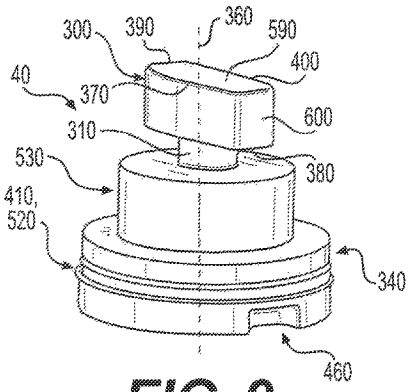
FIG. 9
FIG. 14
FIG. 13
FIG. 12

GROUND ENGAGING TOOL

CROSS-REFERENCE TO RELATED APPLICATION

This application claims the benefit of U.S. Provisional Patent Application No. 62/094,713, filed Dec. 19, 2014, which is hereby incorporated by reference in its entirety.

TECHNICAL FIELD

The present disclosure relates generally to a ground engaging tool and, more particularly, to a ground engaging tool that is removably attachable to an earth-working machine.

BACKGROUND

Earth-working machines, such as, for example, excavators, loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as shrouds, teeth, edge protectors, and other wear members, can he provided on the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many retainer systems have been proposed and used for removably attaching various ground engaging tools to earth-working implements. One example of such a retainer system is disclosed in U.S. Pat. No. 8,776,408 to Stewart et al. In particular, the '408 patent discloses a protective shroud assembly. The assembly includes a shroud adapted to be fitted to a wear edge having a boss. The assembly also includes a locking means. The locking means includes a cylinder having a cam-like surface extending outwardly from a sidewall of the cylinder. The locking means also includes a compressible member. The cam-like surface is adapted to engage the compressible member as the cylinder is rotatably received in an aperture of the shroud, forcing the compressible member against the boss and retaining the shroud in position with respect to the wear member.

The assembly of the '408 patent may provide certain benefits. However, it may have certain drawbacks. For example, material may become lodged between various surfaces of the locking means, making it difficult to remove the shroud from the wear edge. As another example, the locking means itself may be subjected to wear from the abrasion and impacts experienced during earth-working applications. The disclosed embodiments may help solve these and/or other problems known in the art.

SUMMARY

According to one exemplary aspect, the present disclosure is directed to a ground engaging tool. The tool may include an engagement end. The tool may also include a mounting end opposite the engagement end along a longitudinal axis of the tool. The mounting end may include a first mounting leg. The mounting end may also include a second mounting leg, which may include a mounting surface facing the first mounting leg. The second mounting leg may define a cavity in the tool accessible only through an opening in the mounting surface.

In another exemplary aspect, the present disclosure is directed to a ground engaging tool assembly. The assembly may include a ground engaging tool, a lock for the tool, and a compressible component for the tool. The tool may include a first mounting leg. The tool may also include a second mounting leg, which may define a lock cavity in the tool. The lock and the compressible component may be configured to be positioned in the lock cavity. The lock and the tool may be configured such that at least some rotation of the lock in the lock cavity, about a rotational axis in a first direction, compresses the compressible component and translates the lock along the rotational axis away from the first mounting leg.

In still another exemplary aspect, the present disclosure is directed to a ground engaging tool assembly. The assembly may include a ground engaging tool and a lock for the tool. The tool may include an engagement end. The tool may also include a mounting end opposite the engagement end along a longitudinal axis of the tool. The mounting end may include a first mounting leg. The mounting end may also include a second mounting leg, which may include a mounting surface facing the first mounting leg. The second mounting leg may define a lock cavity in the tool accessible only through an opening in the mounting surface. The lock may include a body portion having a first diameter. The lock may also include a neck portion having a second diameter smaller than the first diameter, The neck portion may extend from the body portion. In addition, the lock may include a head portion, which may extend from the neck portion. The head portion may include a bottom surface facing the body portion and a top surface facing away from the body portion. The head portion may also include first and second generally planar end surfaces extending from the bottom surface to the top surface. In addition, the head portion may include first and second cam surfaces extending from the bottom surface to the top surface, and connecting the first and second end surfaces. A portion of the first cam surface adjacent the first generally planar end surface may include a first radius of curvature, and another portion of the first cam surface may include a second radius of curvature larger than the first radius of curvature.

BRIEF DESCRIPTION OF THE DRAWINGS

FIG. 9 is a perspective view of a lock of the ground engaging tool assembly of FIGS. 7A, 7B, and 7C according to one exemplary embodiment of the present disclosure;

FIG. 10 is a top view of the lock of FIG. 9;

FIG. 11 is a front view of the lock of FIG. 9;

FIG. 12 is a bottom view of the lock of FIG. 9;

FIG. 13 is a side view of the lock of FIG. 9;

FIG. 14 is a cross-sectional side view of the lock of FIG. 9;

DETAILED DESCRIPTION

Figure 1:
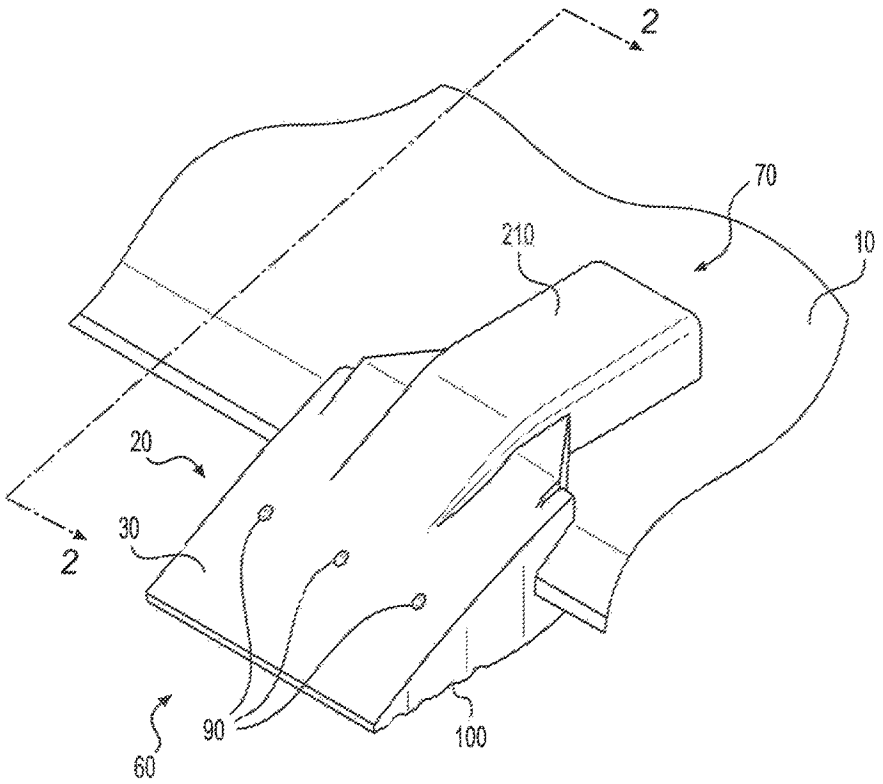
FIG. 1 is a perspective view of a bucket edge of a bucket having a ground engaging tool attached thereto according to one exemplary embodiment of the present disclosure.

FIG. 1 illustrates a bucket edge 10 of a bucket of an earth-working machine, which may be used for excavating or moving work material in a known manner. The bucket may include a variety of ground engaging tool assemblies. For example, the bucket may include a shroud assembly 20, as a ground engaging tool assembly. Shroud assembly 20 may include a shroud 30, which may be configured to be removably attached to bucket edge 10. Shroud 30 may endure the majority of the impact and abrasion caused by engagement with work material, and wear down more quickly and break more frequently than the bucket. Consequently, multiple shrouds 30 may be attached to bucket edge 10, worn down, and replaced before the bucket needs to be replaced. As described below with respect to FIGS. 7A, 7B, 7C, 8A, 8B, and 8C, shroud assembly 20 may also include a lock 40 and a. compressible component 50 to secure shroud 30 to bucket edge 10. While various embodiments of the present disclosure will be described in connection with a particular ground engaging tool (e.g., shroud 30), it should be understood that the present disclosure may be applied to, or used in connection with, any other type of ground engaging tools or components. Further, it should be understood that one or more features described in connection with one embodiment can be implemented in any of the other disclosed embodiments unless otherwise specifically noted.

Figure 2:
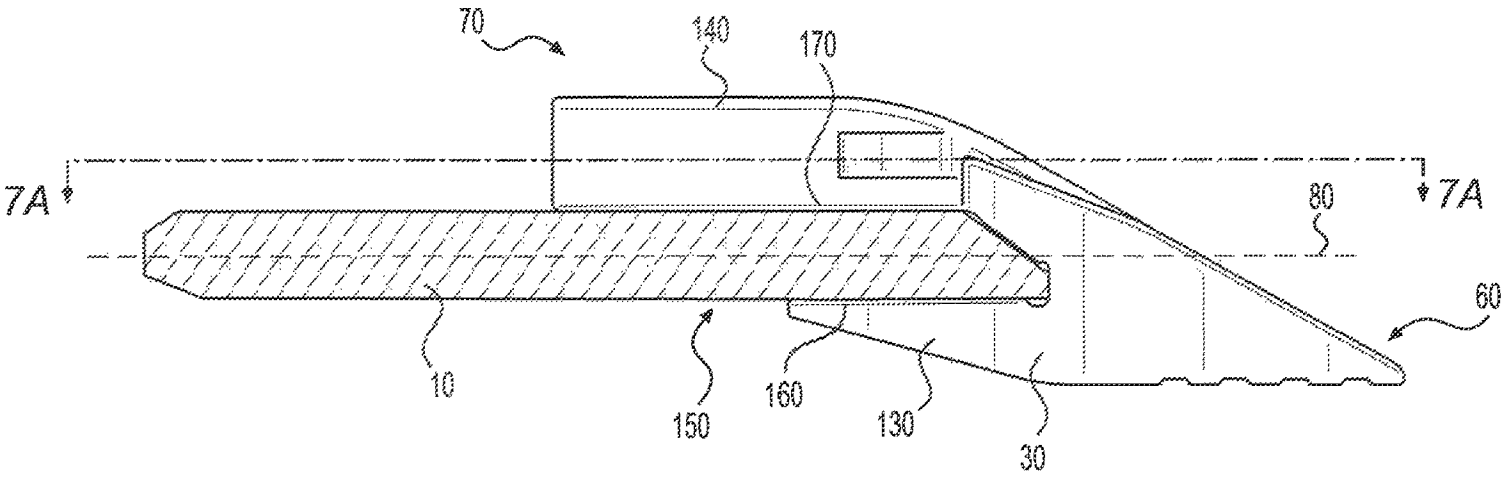
FIG. 2 is a cross-sectional side view of the bucket edge and tool of FIG. 1.
Figure 3:
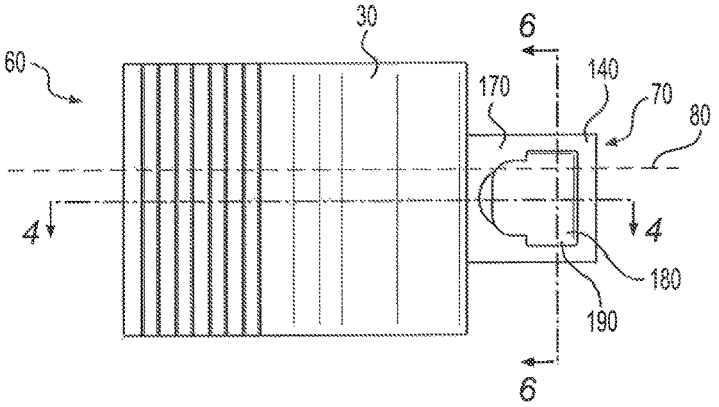
FIG. 3 is a bottom view of the tool of FIG. 1.
Figure 4:
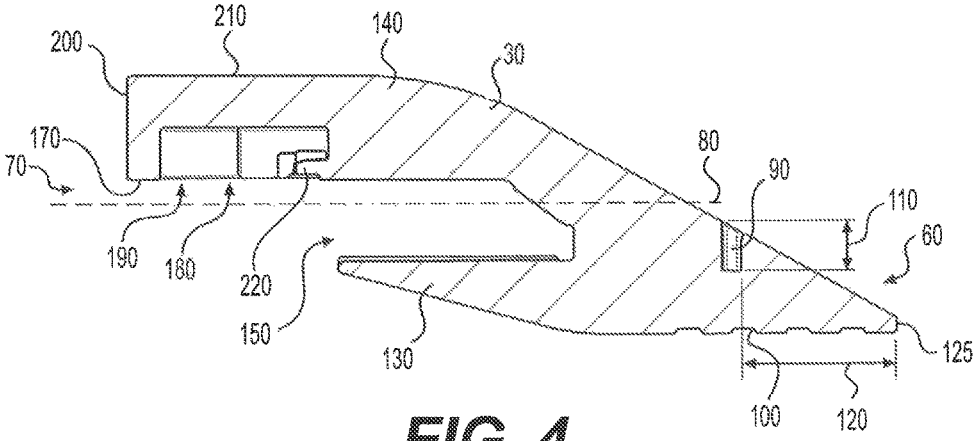
FIG. 4 is a cross-sectional side view of the tool of FIG. 1.
Figure 5:
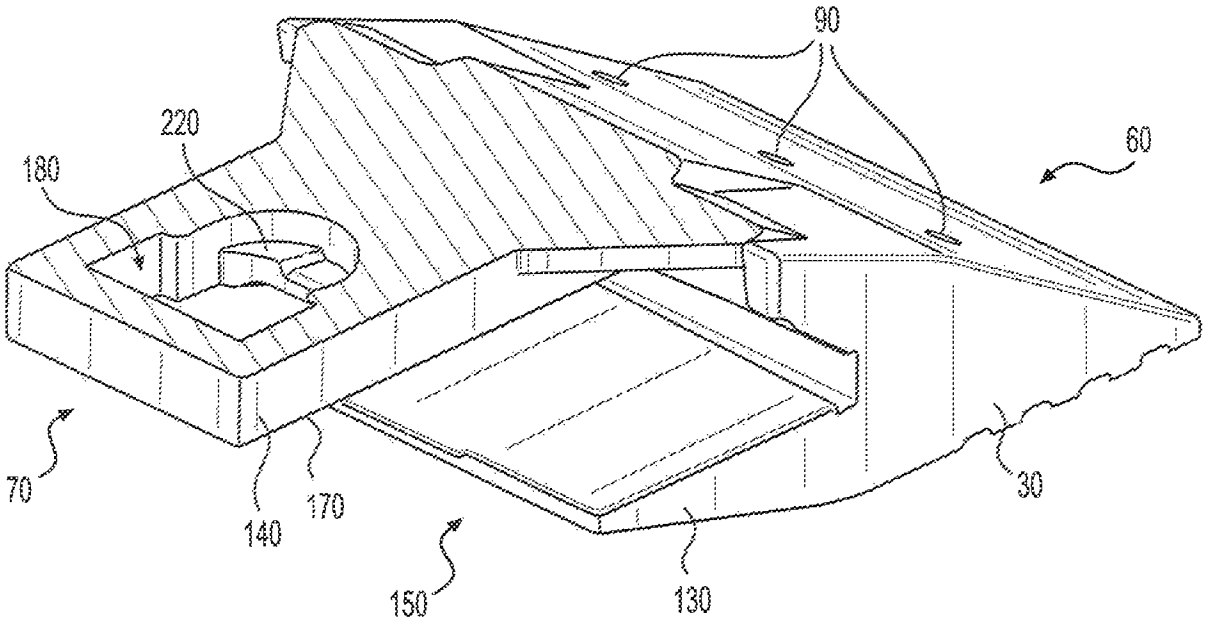
FIG. 5 is a cutaway perspective view of the tool of FIG. 1.

Referring to FIGS. 1-6, shroud 30 may include an engagement end 60 and a mounting end 70 opposite engagement end 60 along a longitudinal axis 80 of shroud 30 (referring to FIGS. 2-4). Engagement end 60 may endure the majority of the impact and abrasion caused by engagement with work material and may wear down more quickly than mounting end 70. Engagement end 60 may thus define one or more wear indicators 90 to facilitate timely replacement of shroud 30. For example, as best shown in FIGS. 1, 4, and 5, wear indicators 90 may include blind holes in engagement end 60, which do not break through a bottom surface 100 of engagement end 60 until bottom surface 100 has worn down enough to expose wear indicators 90 and thereby provide a wear indication. In some embodiments, wear indicators 90 may be full-life wear indicators. In other embodiments, wear indicators 90 may be half-life indicators or other amount-of-life-indicators, or a combination of different amount-of-life-indicators. Referring to FIG. 4, it is contemplated that the amount-of-life indicated by wear indicators 90 may be adjusted by adjusting a depth 110 of wear indicators 90 and/or a distance 120 between wear indicators 90 and a front edge 125 of engagement end 60. For example, the amount of life indicated by wear indicators 90 may be increased by increasing depth 110 and/or distance 120. Conversely, the amount of life indicated by wear indicators 90 may be decreased by decreasing depth 110 and/or distance 120.

Referring to FIG. 2, mounting end 70 may include mounting legs 130, 140, which may define a recess 150 for receiving bucket edge 10. As shown, legs 130, 140 may include opposing mounting surfaces 160, 170 (i.e., surfaces that face each other) for stabilizing shroud 30 relative to bucket edge 10. Referring to FIGS. 3-6, leg 140 may define a lock cavity 180 in shroud 30 for receiving lock 40 and compressible component 50, as discussed below with respect to FIGS. 7A, 7B, 7C, 8A, 8B, and 8C.

Referring to FIG. 4, lock cavity 180 may be accessible only through an opening 190 in surface 170, allowing rear and top surfaces 200, 210 to wear down without exposing lock cavity 180 to any work material which could damage and/or inhibit movement of lock 40 and/or compressible component 50. As best shown in FIGS. 3 and 5, opening 190 may be at least partially rectangle-shaped to facilitate insertion of a rectangular compressible component 50 in lock cavity 180.

Figure 6:
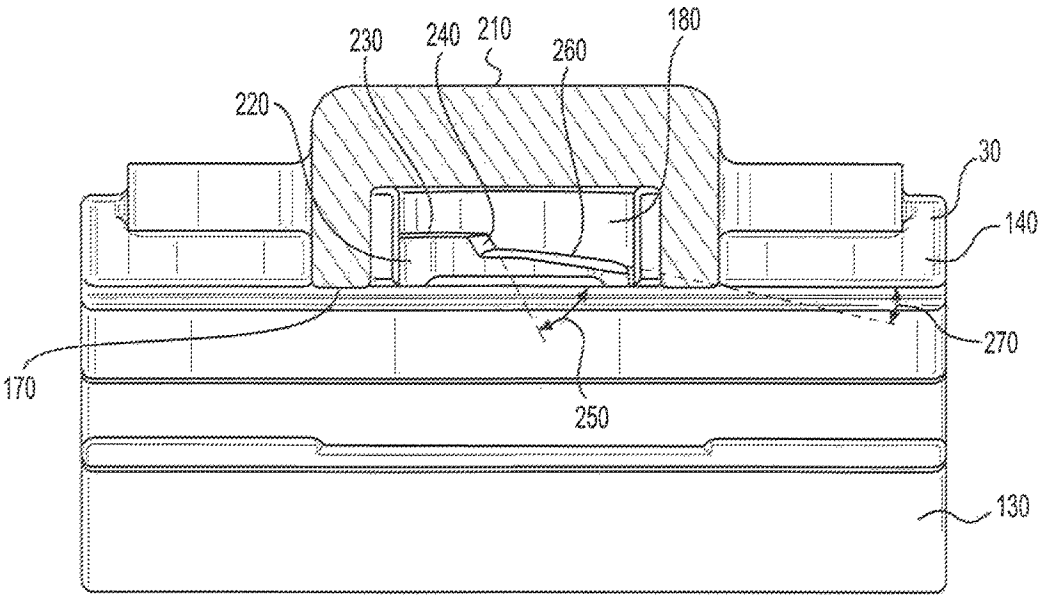
FIG. 6 is a cross-sectional rear view of the tool of FIG. 1.

Referring to FIGS. 4-6, leg 140 may also define a flange 220, which may extend into cavity 180 along longitudinal axis 80, away from engagement end 60. Flange 220 may be adjacent surface 170, and may be engaged by lock 40 to secure shroud 30 to bucket edge 10, as discussed below with respect to FIGS. 7A, 7B, 7C, 8A, 8B, and 8C. As best shown in FIG. 6, flange 220 may include a flange surface 230, which may extend generally parallel to surface 170. Flange 220 may also include a flange surface 240, which may slope away from flange surface 230, toward surface 170, at an angle 250 relative to surface 170. In addition, flange 220 may include a flange surface 260, which may slope away from flange surface 240, toward surface 170, at an angle 270 relative to surface 170. Angle 250 may be less than 90 degrees, and angle 270 may be smaller than angle 250.

Figure 7A:
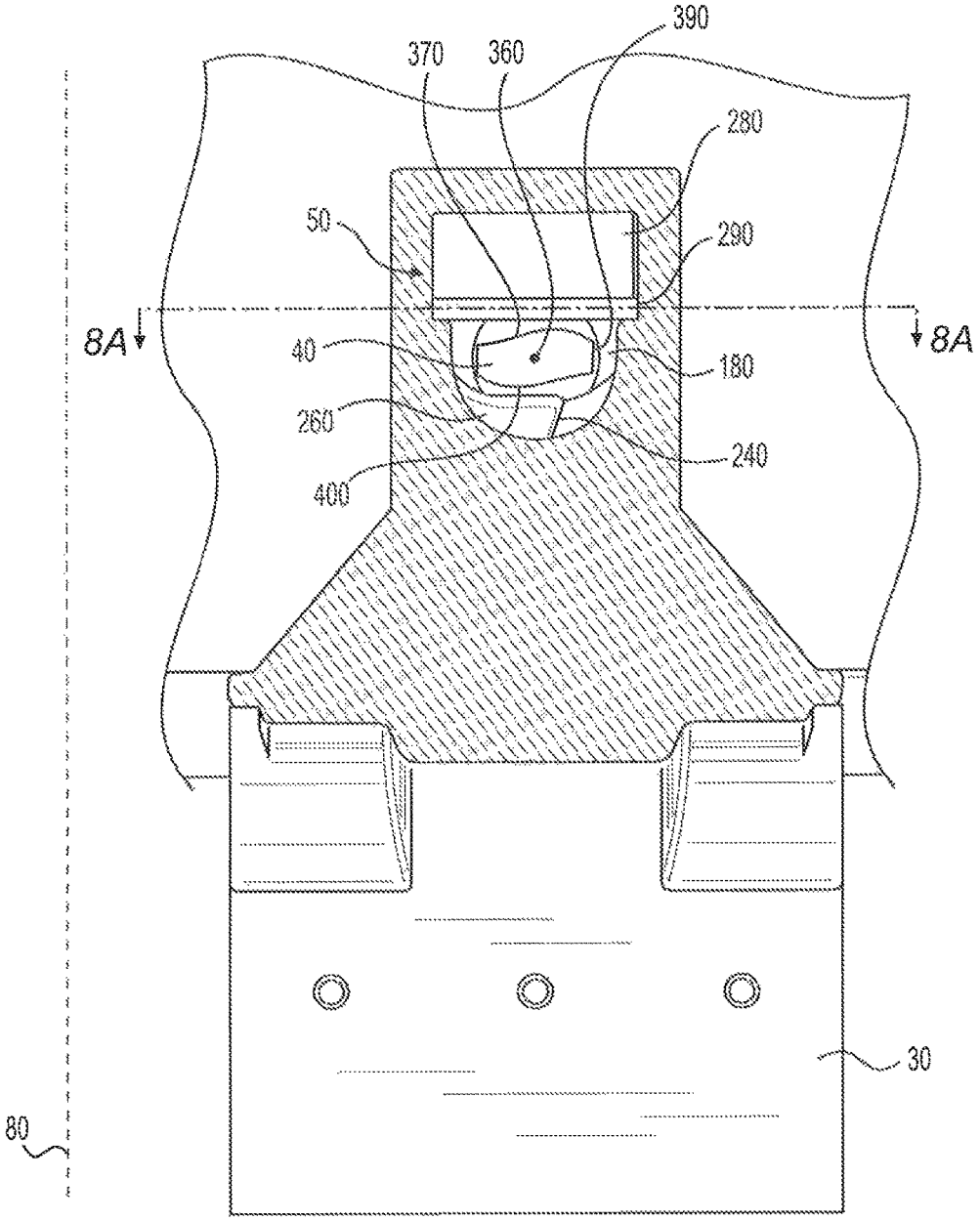
FIGS. 7A, 7B, and 7C are cross-sectional top views of a ground engaging tool assembly according to one exemplary embodiment of the present disclosure in various states of assembly.
Figure 8A:
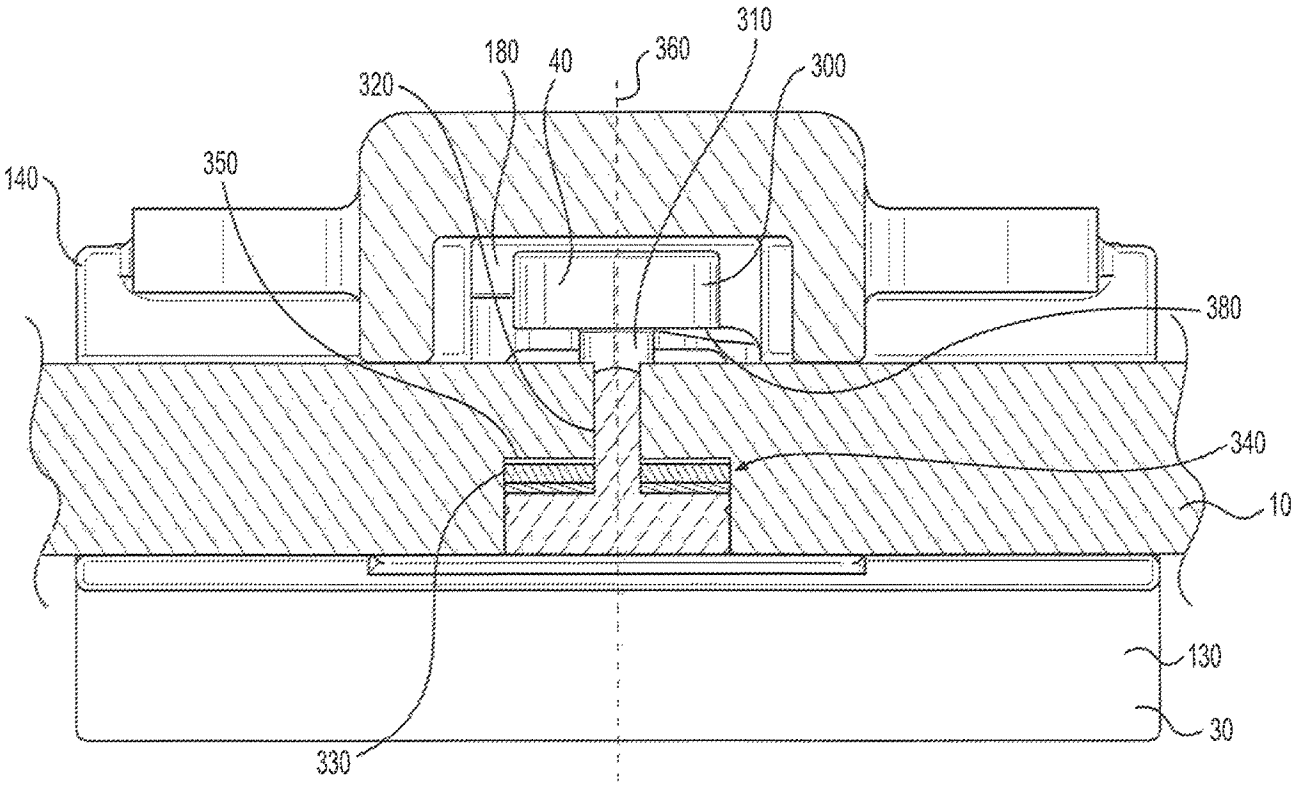
FIGS. 8A, 8B, and 8C are cross-sectional rear views of a ground engaging tool and a lock of the ground engaging tool assembly of FIGS. 7A, 7B, and 7C in the various states of assembly of FIGS. 7A, 7B, and 7C, respectively.

Referring to FIGS. 7A and 8A, compressible component 50 and lock 40 may be configured to be positioned in lock cavity 180. For example, compressible component 50 may be inserted into cavity 180 before shroud 30 is placed on bucket edge 10. As shown, compressible component 50 may include an elastomeric material 280 (e.g., rubber, foam, or another type of elastomeric material) and an inelastic material 290 (e.g., metal). Elastomeric material 280 may act as a spring, and inelastic material 290 may distribute forces along elastomeric material 280 to ensure reactive forces provided by elastomeric material 280 are directed approximately along longitudinal axis 80. Alternatively, compressible component 50 may include only elastomeric material 280, not inelastic material 290. In yet another alternative, compressible component 50 may include a compressible material other than elastomeric material 280. For example, compressible component 50 may include one or more coil springs, leaf springs, and/or other types of springs.

Lock 40 may be inserted into cavity 180 after shroud 30 is placed on bucket edge 10. In particular, a head portion 300 and neck portion 310 of lock 40 may be inserted into cavity 180 through a bore 320 and a counterbore 330 of bucket edge 10. Since other portions of lock 40 may remain in bore 320 and counterbore 330, cavity 180 (and leg 140) may thus be shorter than lock 40, minimizing the profile of shroud 30 and allowing shroud 30 to more easily penetrate work material. Once a biasing component 340 of lock 40 engages a planar surface 350 of counterbore 330, lock 40 may be rotated about rotational axis 360 to secure shroud 30 to bucket edge 10.

Figure 7B:
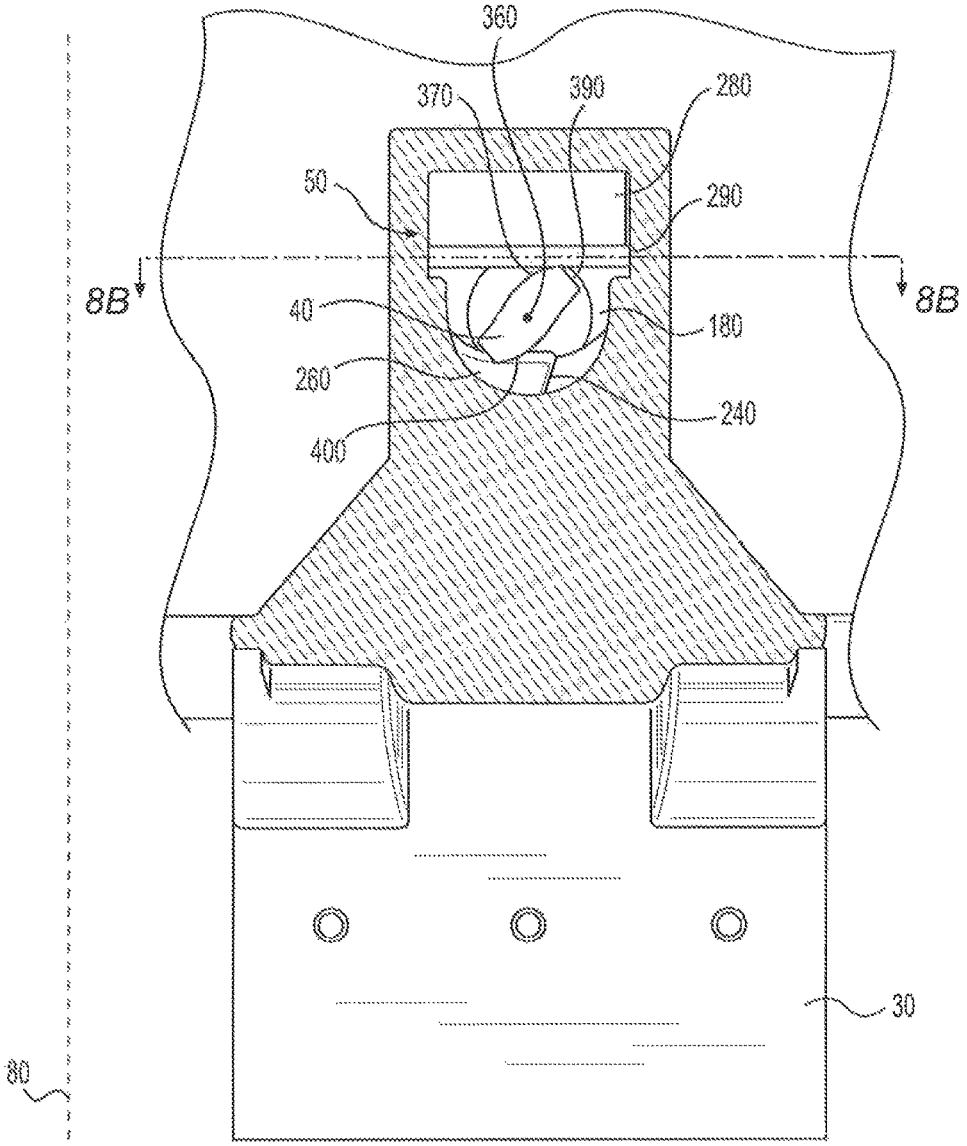
Figure 8B:
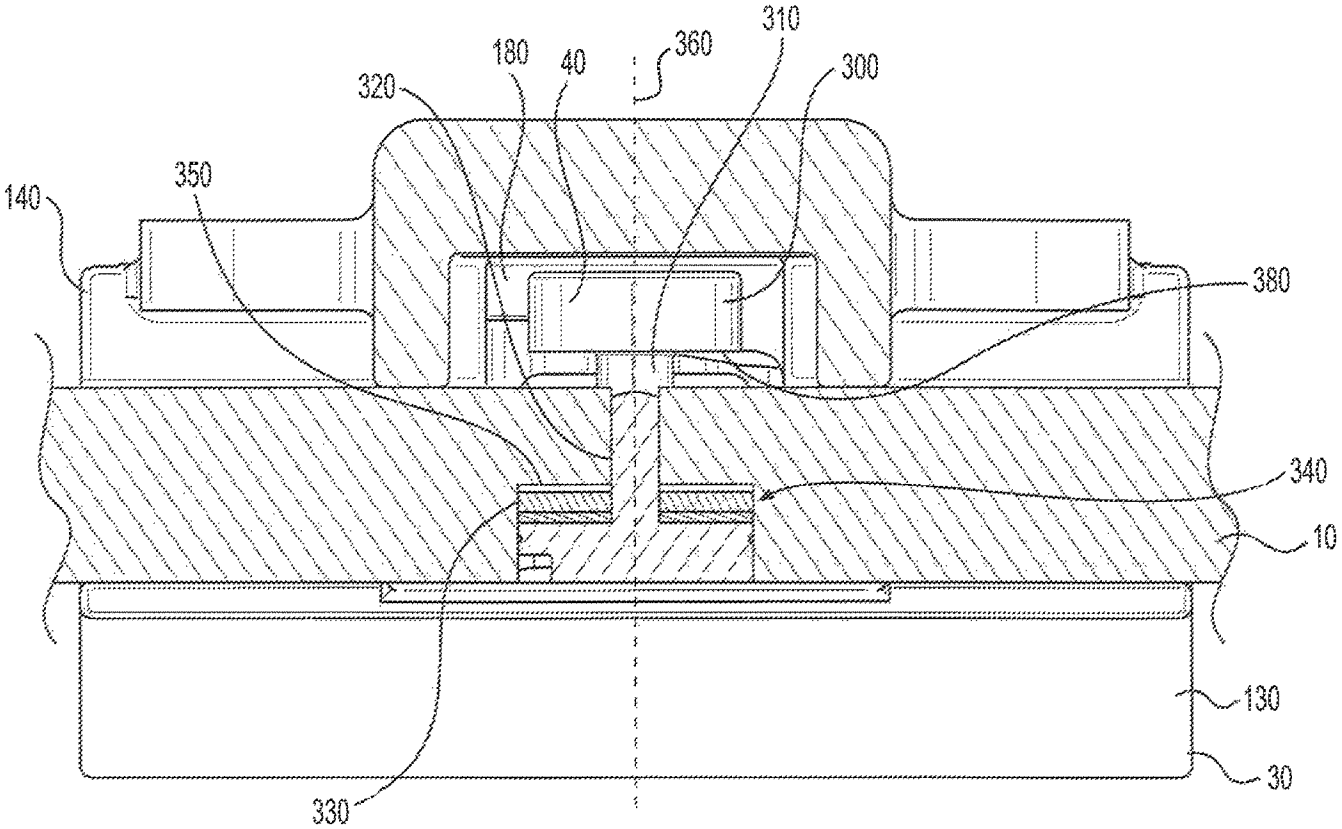

Referring to FIGS. 7B and 8B, lock 40 and shroud 30 may be configured such that at least some rotation of lock 40 in cavity 180 about rotational axis 360 in a first direction compresses compressible component 50 and translates lock 40 along rotational axis 360 away from leg 130. For example, head portion 300 of lock 40 may include a cam surface 370, which may engage inelastic material 290 to compress elastomeric material 280 as lock 40 is rotated, thereby pulling shroud 30 onto bucket edge 10. In addition, head portion 300 may include a bottom surface 380, which may engage and ride up flange surface 260 to translate lock 40 along rotational axis 360 away from leg 130, as lock 40 is rotated. Such translation may also compress biasing component 340 of lock 40 against planar surface 350 of counterbore 330, drawing bucket edge 10 closer to leg 140 and preventing work material from entering cavity 180 through bore 320 and counterbore 330.

Figure 7C:
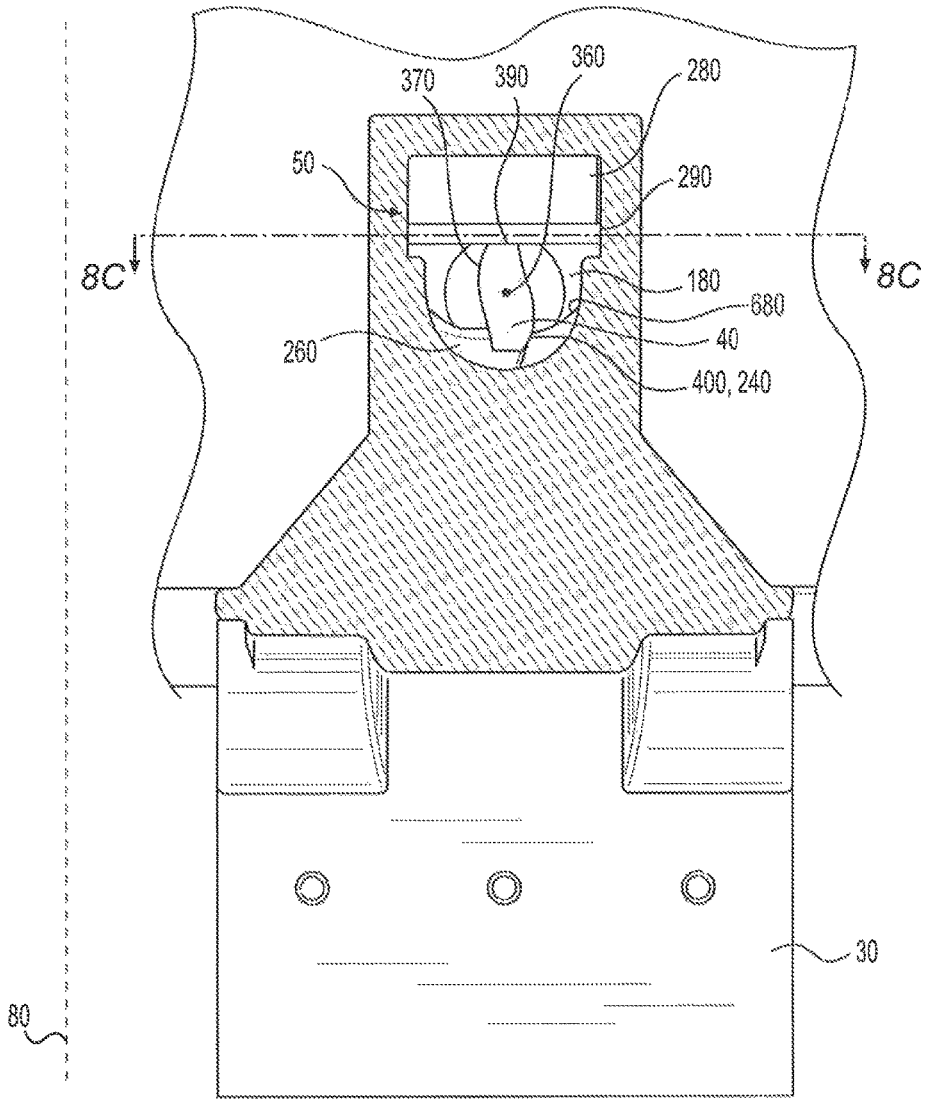
Figure 8C:
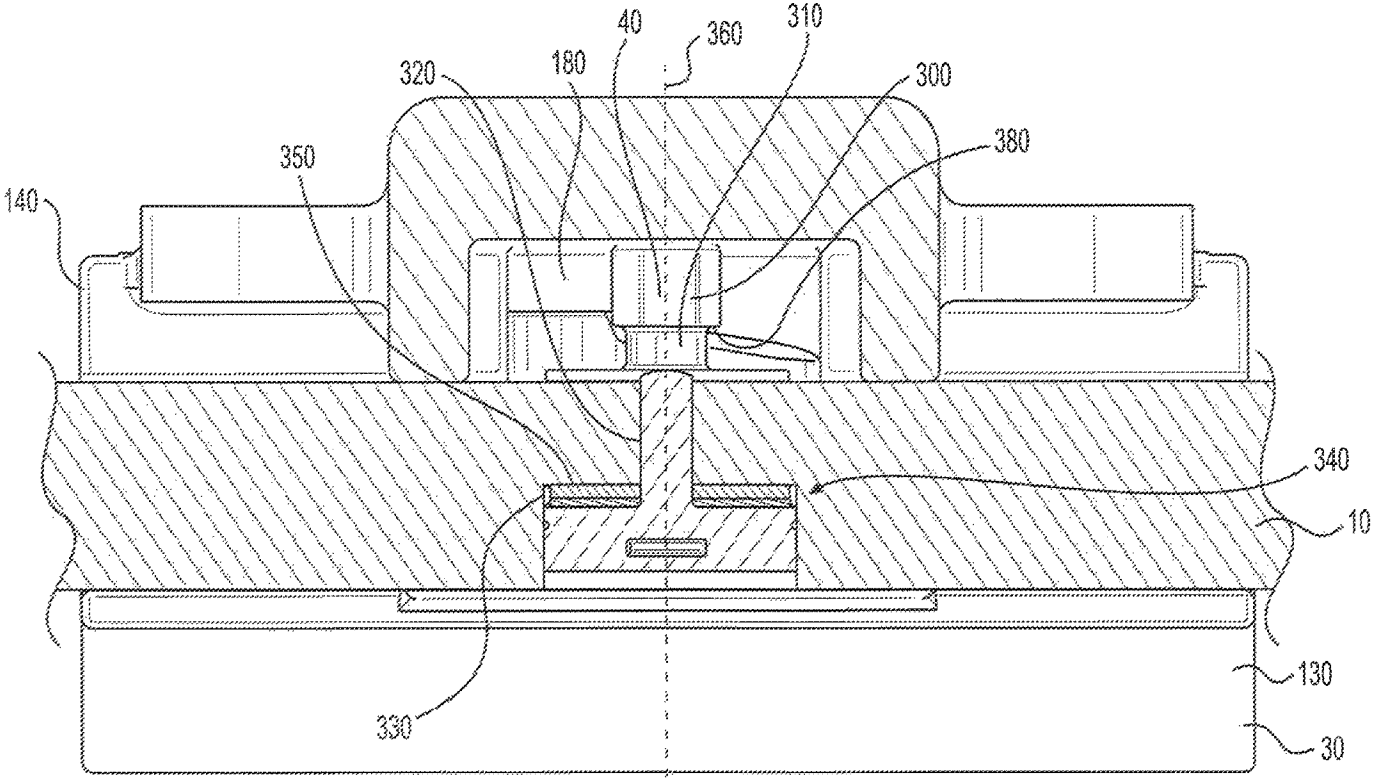
Figure 17:
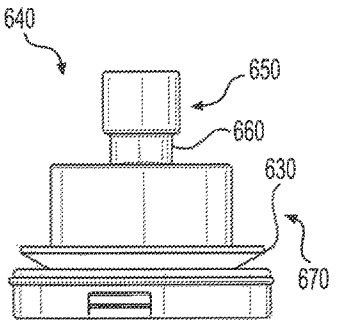
FIG. 17 is a front view of the lock of FIG. 15.
Figure 16:
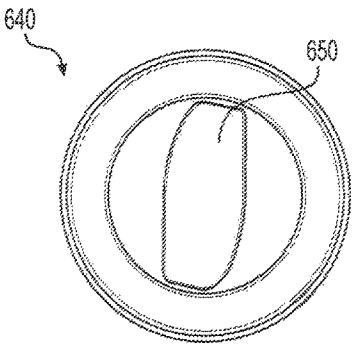
FIG. 16 is a top view of the lock of FIG. 15.
Figure 15:
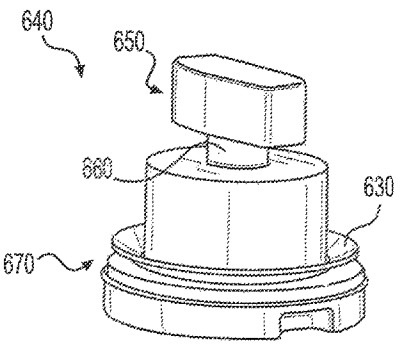
FIG. 15 is a perspective view of a lock for a ground engaging tool assembly according to another exemplary embodiment of the present disclosure.
Figure 20:
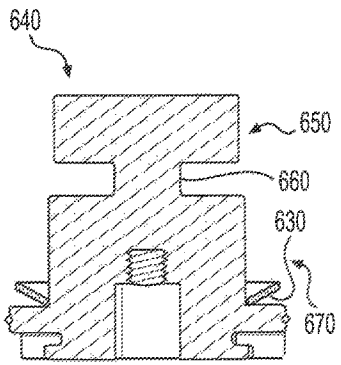
FIG. 20 is a cross-sectional side view of the lock of FIG. 15.
Figure 19:
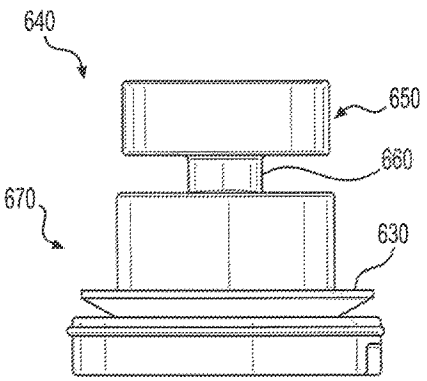
FIG. 19 is a side view of the lock of FIG. 15.
Figure 18:
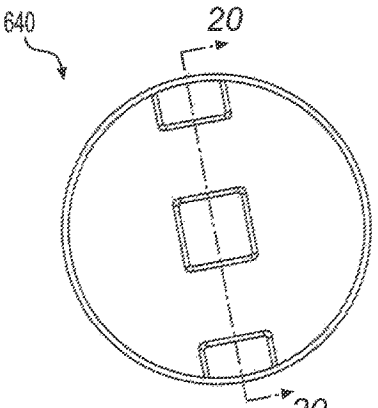
FIG. 18 is a bottom view of the lock of FIG. 15.

Referring to FIGS. 7C and 8C, lock 40 and shroud 30 may also be configured such that further rotation of lock 40 in cavity 180 (i.e., rotation beyond that shown in FIGS. 7B and 8B), about rotational axis 360 in the first direction, allows decompression of compressible component 50 and further translates lock 40, along rotational axis 360, away from leg 130. For example, head portion 300 may include a generally planar end surface 390 positioned relative to cam surface 370 such that when end surface 390 contacts inelastic material 290, it allows decompression of compressible component 50 as lock 40 is rotated. Bottom surface 380 of head portion 300, however, may continue to ride up flange surface 260 to further translate lock 40, along rotational axis 360, away from leg 130, as lock 40 is rotated. As shown in FIGS. 7C and 8C, such translation and rotation may be stopped when a cam surface 400 of head portion 300 contacts flange surface 240, securing lock 40 in a locked position with end surface 390 contacting inelastic material 290 and bottom surface 380 contacting flange surface 260. Lock 40 and shroud 30 may thus be configured to prevent further rotation of lock 40 in cavity 180 (i.e., beyond that shown in FIGS. 7C and 8C), about rotational axis 360 in the first direction, once rotation of lock 40, in the first direction, has compressed compressible component 50 and then allowed decompression of compressible component 50. Rotation about rotational axis 360 in a second direction opposite the first direction, however, may still be possible to unlock and remove shroud 30 from bucket edge 10. Specifically, such rotation may be possible until a portion of cam surface 400 adjacent end surface 390 contacts a surface 680 of flange 220. This contact may disturb any work material packed between components of shroud assembly 20 and/or bucket edge 10, easing removal of shroud 30 from bucket edge 10.

As shown in FIGS. 9-14 and discussed above, lock 40 may include a head portion 300, a neck portion 310, and a biasing component 340. In addition, lock 40 may include a body portion 410, which may include a plurality of tool interfaces. For example, body portion 410 may include tool interfaces 420, 440, and/or 460.

Referring to FIGS. 12 and 14, tool interface 420 may be configured to receive torque to rotate lock 40 about rotational axis 360. As shown, tool interface 420 may include a generally square-shaped recess extending into body portion 410 from a bottom surface 430 of body portion 410. Alternatively, tool interface 420 may include other features configured to be engaged by a tool for applying torque to lock 40 about rotational axis 360.

Referring to FIG. 14, tool interface 440 may be configured to receive force to translate lock 40 along rotational axis 360. As shown, tool interface 440 may include a threaded bore extending into body portion 410 from a top surface 450 of tool interface 420. Alternatively, tool interface 440 may include other features configured to be engaged by a tool for applying force to lock 40 along rotational axis 360.

Referring to FIGS. 9, 11, 12, and 14, tool interfaces 460 may also be configured to receive force to translate lock 40 along rotational axis 360. As shown in FIG. 14, each tool interface 460 may be a slot 470 with top and bottom portions 480, 490, and may extend into body portion 410 from a circumferential surface 500 of body portion 410, adjacent bottom surface 430. Top portion 480 may extend further into body portion 410 than bottom portion 490, so that a top surface 510 of bottom portion 490 can be used to pry lock 40 out of cavity 180 along rotational axis 360. Although lock 40 is illustrated as having two tool interfaces 460, lock 40 may alternatively have fewer or more than two tool interfaces 460. It should be understood, however, that altering the number of tool interfaces 460 could impact the usability of lock 40. In particular, lock 40, as illustrated, is rotationally symmetric about rotational axis 360, meaning that it can be rotated a certain amount about rotational axis 360 and still function in exactly the same way. Specifically, lock 40, as illustrated, is second order rotationally symmetric about rotational axis 360. This means that lock 40 can be rotated 180 degrees about rotational axis 360 and still function in exactly the same way, allowing it to be inserted into lock cavity 180 in either of two configurations, 180 degrees apart from each other about rotational axis 360.

As shown in FIGS. 9-11, 13, and 14, body portion 410 may include a generally cylindrical lower section 520 and a generally cylindrical upper section 530. Referring to FIG. 10, lower section 520 may have a diameter 540, and upper section 530 may have a diameter 550, which may be smaller than diameter 540. In some embodiments and as best shown in FIG. 14, lower section 520 may define a groove 560 extending circumferentially around lower section 520, which may be configured to receive an O-ring 570 to seal lower section 520 against counterbore 330 of bucket edge 10 (referring to FIGS. 8A, 8B, and 8C). Alternatively, body portion 410 may be generally frustum-shaped, and may or may not define a groove extending circumferentially around itself In such embodiments, the smallest diameter of body portion 410 may be equivalent to diameter 550.

Referring to FIGS. 9, 11, and 13, neck portion 310 may be generally cylindrical, and may have a diameter 580, which may be smaller than diameter 550. Alternatively, neck portion 310 may be generally frustum-shaped. Neck portion 310 may extend from body portion 410 along rotational axis 360. For example, neck portion 310 may extend from upper section 530.

As best shown in FIGS. 9, 10, and 13, head portion 300 may extend from neck portion 310 along rotational axis 360. As discussed above, head portion 300 may include bottom surface 380. Bottom surface 380 may be generally planar, and may face body portion 410. Head portion 300 may also include a top surface 590, which may be generally planar. Top surface 590 may face away from body portion 410, and may be approximately parallel to bottom surface 380. Head portion 300 may also include generally planar end surfaces 390, 600, which may extend from bottom surface 380 to top surface 590, and which may be approximately perpendicular to surfaces 380, 590.

Referring to FIGS. 9 and 10, and as discussed above, head portion 300 may include cam surfaces 370, 400, which may extend from bottom surface 380 to top surface 590, and which may connect end surfaces 390, 600. Cam surfaces 370, 400 may be approximately perpendicular to surfaces 380, 590. As shown, radii of the curves of cam surfaces 370, 400 may change between end surfaces 390, 600. For example, in some embodiments, a portion of cam surface 370 not adjacent end surface 390 may have a larger radius of curvature than a portion of cam surface 370 adjacent end surface 390. By minimizing the radius of curvature of cam surface 370 near end surface 390, the amount of force applied to compressible component 50 by this portion of cam surface 390 may be maximized for a given amount of torque applied to lock 40 to rotate lock 40 about rotational axis 360. Such maximization of the force may be desirable, since the portion of cam surface 370 adjacent end surface 390 may apply force to compressible component 50 when compressible component 50 has already been partially compressed and is thus exerting a greater reactive force than in its uncompressed state. Like cam surface 370, in some embodiments, a portion of cam surface 400 not adjacent end surface 600 may have a larger radius of curvature than a portion of cam surface 400 adjacent end surface 600. Alternatively, one or both of cam surfaces 370, 400 may be otherwise shaped to apply different forces to compressible component 50 depending on a spring constant associated with compressible component 50.

As best shown in FIGS. 9, 11, 13, and 14, biasing component 340 may surround upper section 530 of body portion 410. Biasing component 340 may include an elastomeric material 610 (e.g., rubber, foam, or another type of elastomeric material). In addition, biasing component 340 may include a metal material 620, which may separate material 610 from lower section 520 of body portion 410. Metal material 620 may reduce friction between biasing component 340 and lower section 520, allowing lock 40 to rotate more easily about rotational axis 360.

Ground engaging tools and the associated assemblies of the present disclosure are not limited to the exemplary configurations described above. Certain exemplary aspects of the present disclosure may provide various alternative and/or additional configurations of assemblies for removably attaching ground engaging tools to an implement. For example, further modifications to a lock may be possible without impacting the performance of the lock. In one particular example, illustrated in FIGS. 15-20, a lock 640 may be similar to lock 40 but differ in certain ways. For example, like lock 40, lock 640 may include a head portion 650, a neck portion 660, and a body portion 670, which may be identical to head portion 300, neck portion 310, and body portion 410, respectively. Instead of including biasing component 340, however, lock 640 may include a biasing component 630. As shown, biasing component 630 may include a metal coned-disc spring, sometimes referred to as a Belleville washer. Alternatively, biasing component 630 may include one or more coil springs, leaf springs, and/or other types of springs, and may include another type of material (e.g., plastic). In any case, biasing component 630 may function similarly to biasing component 340, but may be more or less desirable in certain applications.

INDUSTRIAL APPLICABILITY

The disclosed ground engaging tool assemblies may be applicable to various earth-working machines, such as, for example, excavators, loaders, hydraulic mining shovels, cable shovels, bucket wheels, bulldozers, and draglines. When installed, ground engaging tools of the disclosed ground engaging tool assemblies may protect various implements associated with the earth-working machines against wear in the areas where the most damaging abrasions and impacts occur and, thereby, prolong the useful life of the implements.

The disclosed configurations of various components may provide secure and reliable attachment and detachment of ground engaging tools to various earth-working implements, and may have various advantages over previous retainer systems. For example, since lock cavity 180 may be accessible only through opening 190 in surface 170, rear and top surfaces 200, 210 of shroud 30 may wear down without exposing lock cavity 180 to any work material which could damage and/or inhibit movement of lock 40 and/or compressible component 50. Additionally, since lock 40 may be positioned within cavity 180, bore 320, and counterbore 330, lock 40 may be protected from the abrasion and impacts experienced by shroud 30 during earth-working applications. The operation of the disclosed components will now be described.

First, the disclosed compressible component 50 may be inserted into cavity 180 of shroud 30. Then, after shroud 30 is placed on bucket edge 10, the disclosed lock 40 may be inserted into cavity 180. In particular, head portion 300 and neck portion 310 of lock 40 may be inserted into cavity 180 through bore 320 and counterbore 330 of bucket edge 10. Once biasing component 340 of lock 40 engages planar surface 350 of counterbore 330, lock 40 may be rotated about rotational axis 360 to secure shroud 30 to bucket edge 10. Such rotation may cause bottom surface 380 of lock 40 to engage and ride up flange surface 260 to translate lock 40 along rotational axis 360, compressing biasing component 340 of lock 40 against planar surface 350 of counterbore 330 and drawing bucket edge 10 closer to leg 140 to stabilize shroud 30 and prevent work material from entering cavity 180 through bore 320 and counterbore 330. The rotation may also cause cam surface 370 of lock 40 to engage inelastic material 290 to compress elastomeric material 280, thereby pulling shroud 30 onto bucket edge 10. The rotation may continue until it is stopped by cam surface 400 of lock 40 contacting flange surface 240, securing lock 40 in a locked position with end surface 390 contacting inelastic material 290 and bottom surface 380 contacting flange surface 260. In some embodiments, before the rotation is stopped, the rotation may allow decompression of compressible component 50. Such decompression may prevent lock 40 from leaving the locked position by opposing any loosening of lock 40. It may, however, still be possible to remove lock 40 (and shroud 30) by overcoming this opposition with outside torque applied to lock 40 using tool interface 420.

It will be apparent to those skilled in the art that various modifications and variations can be made to the disclosed embodiments. Other embodiments will be apparent to those skilled in the art from consideration of the specification and practice of the disclosed assemblies. It is intended that the specification and examples be considered as exemplary only, with a true scope being indicated by the following claims and their equivalents.

What is claimed is:

1. A ground engaging tool, comprising:

an engagement end; and a mounting end opposite the engagement end along a longitudinal axis of the tool, and including:

a first mounting leg; and a second mounting leg having a mounting surface facing the first mounting leg, and defining a cavity extending into the mounting surface in the second mounting leg and accessible only through an opening in the mounting surface with no opening from the cavity to any outer surface of the second mounting leg other than the mounting surface, wherein the second mounting leg defines a flange extending into the cavity along the longitudinal axis, away from the engagement end.

2. The tool of claim 1, wherein the flange is adjacent the mounting surface.

3. The tool of claim 2, wherein the flange includes:

a first flange surface extending generally parallel to the mounting surface;

a second flange surface sloping away from the first flange surface toward the mounting surface at a first angle relative to the mounting surface; and a third flange surface sloping away from the second flange surface toward the mounting surface at a second angle relative to the mounting surface;

wherein the second angle is smaller than the first angle.

4. The tool of claim 3, wherein the first angle is less than 90 degrees.

5. The tool of claim 1, wherein the opening is at least partially rectangle-shaped.

6. The tool of claim 1, wherein the engagement end defines at least one wear indicator.

7. The tool of claim 6, wherein the at least one wear indicator includes a blind hole in the engagement end.

8. The tool of claim 7, wherein the at least one wear indicator includes a full-life wear indicator.

9. The tool of claim 7, wherein the at least one wear indicator includes a half-life wear indicator.

* * * * *